US006135330A

United States Patent [19]

Wang

[11] Patent Number: 6,135,330

[45] Date of Patent: Oct. 24, 2000

[54] SUIT HANGER

[76] Inventor: Wen-Tsan Wang, P.O. Box 82-144, Taipei, Taiwan

[21] Appl. No.: 09/422,961

[22] Filed: Oct. 22, 1999

[51] Int. Cl.[7] ..... A47Q 25/14; A47Q 23/40

[52] U.S. Cl. ..... 223/85; 223/94; 223/87; 223/DIG. 4

[58] Field of Search ..... 223/85, 89, 94, 223/92, 87, DIG. 4; 221/113

[56] References Cited

U.S. PATENT DOCUMENTS

| | | | |
|---|---|---|---|
| 2,335,243 | 11/1943 | Grieshaber | 223/85 |
| 4,126,252 | 11/1978 | Wasserman | 223/87 |
| 4,168,858 | 9/1979 | Tatematsu | 223/94 |
| 5,620,118 | 4/1997 | Kolton et al. | 223/85 |
| 6,006,963 | 1/1999 | Paine | 223/85 |

*Primary Examiner*—Bibhu Mohanty

*Attorney, Agent, or Firm*—A & J

[57] ABSTRACT

It is one object of the present invention to provide a suit hanger, which is inexpensive to manufacture. It is another object of the present invention to provide a suit hanger, which is packed in a detached manner before sale. It is still another object of the present invention to provide a suit hanger, which is packed in a detached manner to fit DIY (Do-It-Yourself) requirement. To achieve these and other objects of the present invention, there is provided a suit hanger comprised of a hanger body, a reinforcing wire rod, a barrel, and a swivel hook. The hanger body is made of a flexible sheet material having two sockets and two studs at two opposite sides. The studs are respectively fastened to the sockets to hold the flexible sheet material in a particular shape practical for holding a suit in shape. The reinforcing wire rod is coupled between the studs. The barrel is mounted around the reinforcing wire rod, having a through hole. The swivel hook is coupled to the through hole at the barrel for hanging.

4 Claims, 3 Drawing Sheets

SUIT HANGER

BACKGROUND OF THE INVENTION

The present invention relates to a suit hanger, and more particularly to a simple, inexpensive suit hanger, which keeps the loaded suit in shape.

Regular clothes or suit hangers are commonly made of plastics, wooden material, or metal. Bending a plastic-coated wire rod into shape makes a simple clothes hanger. This structure of clothes hanger is used to hold clothes on a clothesline or the like for drying in the open air. A suit hanger is a deluxe clothes hanger used to hold a suit in shape. In order to hold a suit in shape, the shoulders of a suit hanger must be specially designed (for example, the shoulders are made having a width gradually increased from the swivel hanger at the center of the suit hanger toward the respective end. This structure of deluxe suit hanger is complicated and expensive to manufacture. Furthermore, because this structure of suit hanger occupies much storage space because it is not detachable.

SUMMARY OF THE INVENTION

It is one object of the present invention to provide a suit hanger, which is inexpensive to manufacture. It is another object of the present invention to provide a suit hanger, which is packed in a detached manner before sale. It is still another object of the present invention to provide a suit hanger, which is packed in a detached manner to fit DIY (Do-It-Yourself) requirement. To achieve these and other objects of the present invention, there is provided a suit hanger comprised of a hanger body, a reinforcing wire rod, a barrel, and a swivel hook. The hanger body is made of a flexible sheet material having two sockets and two studs at two opposite sides. The studs are respectively fastened to the sockets to hold the flexible sheet material in a particular shape practical for holding a suit in shape. The reinforcing wire rod is coupled between the studs. The barrel is mounted around the reinforcing wire rod, having a through hole. The swivel hook is coupled to the through hole at the barrel for hanging.

DETAILED DESCRIPTION OF THE PREFERRED EMBODIMENT

Figure 1:
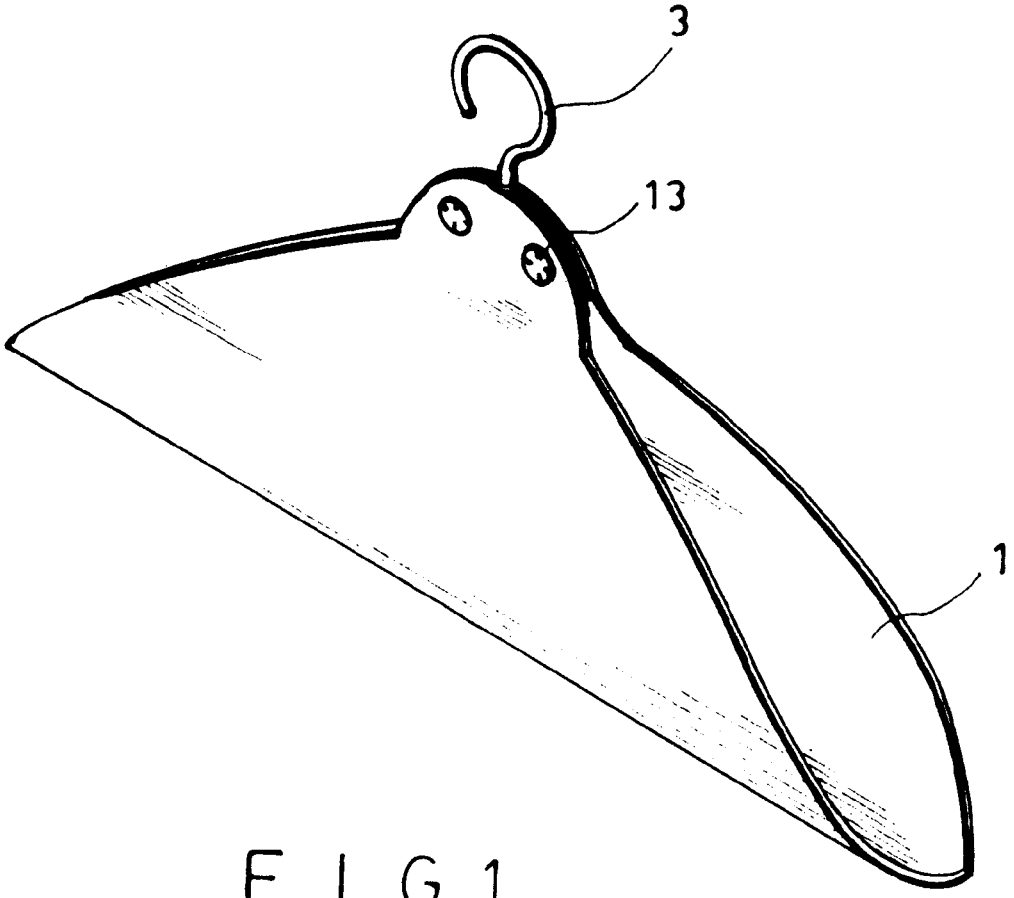
FIG. 1 is a perspective view of a suit hanger according to the present invention.
Figure 2:
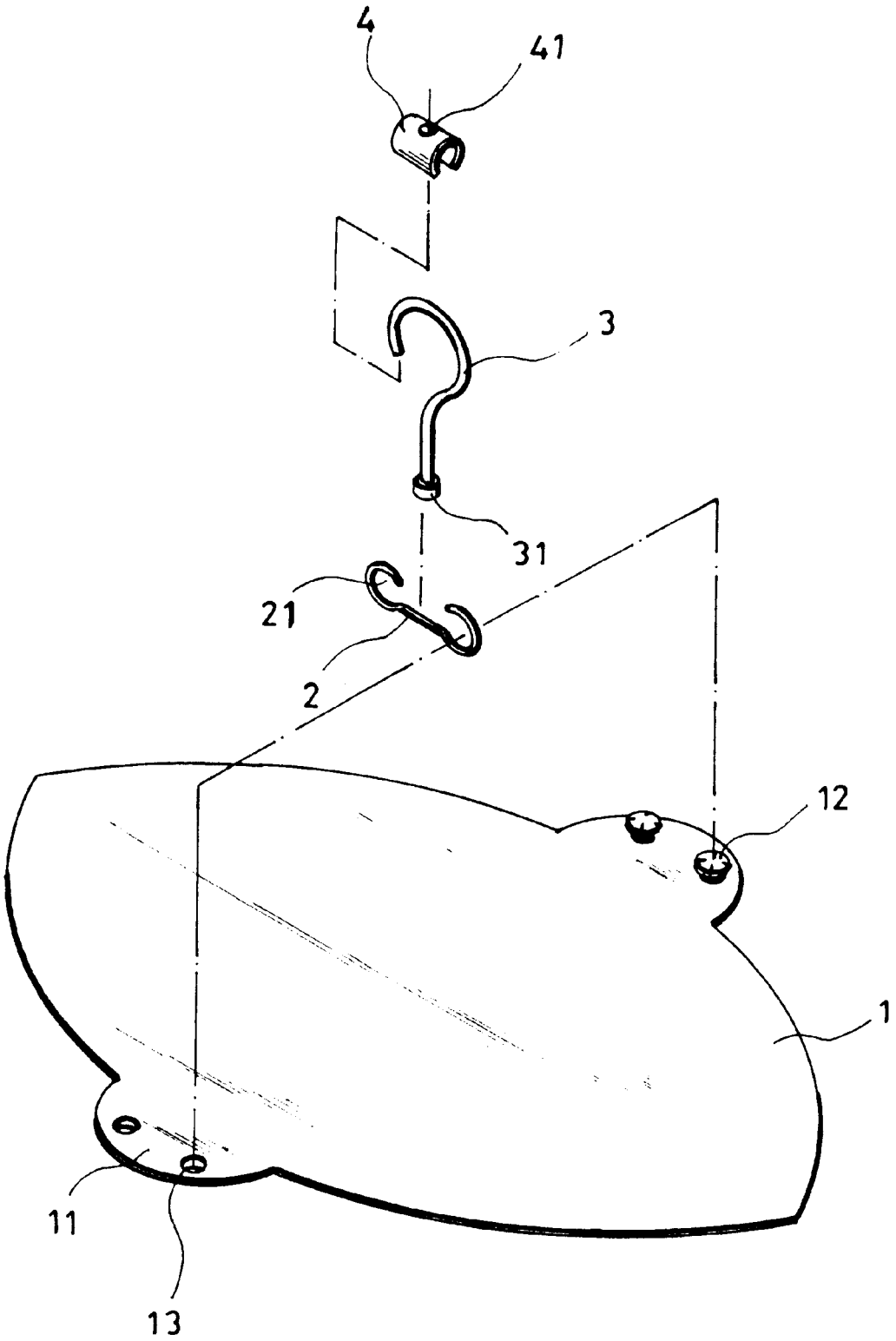
FIG. 2 is an exploded view of the suit hanger shown in FIG. 1.

Referring to FIGS. 1 and 2, a suit hanger in accordance with the present invention is generally comprised of a hanger body 1, a reinforcing wire rod 2, a swivel hook 3, and a coupling barrel 4.

Figure 3:
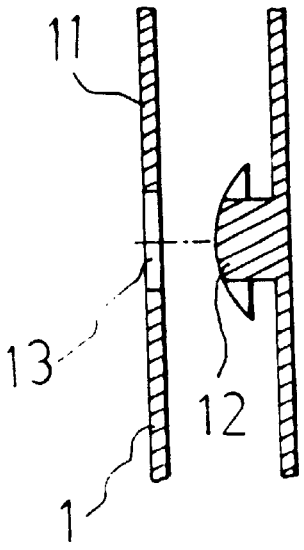
FIG. 3 is a sectional view of a part of the hanger body, showing the arrangement of the socket and the stud according to the present invention.

Referring to FIG. 3 and FIGS. 1 and 2 again, the hanger body 1 is made of a flexible sheet material comprising two lugs 11 extended from the border thereof at two opposite sides, studs 12 and sockets 13 symmetrically formed integral with the lugs 11. According to the present preferred embodiment, the hanger body 1 is injection-molded from plastics. According to the present preferred embodiment, there are two sockets 13 at one lug 11 and two studs 12 at the other lug 11. As illustrated in FIG. 3, each stud 12 has a rounded dome-like head. Each socket 13 defined a tapered through hole. During assembly, the hanger body 1 is folded up, and then the studs 12 are respectively forced into engagement with the sockets 13, keeping the hanger body 1 in shape. The reinforcing wire rod 2 has two hooked ends 21 respectively hooked on the shank of each of the studs 12. The barrel 4 is rolled up from a metal sheet, having a through hole 41 through the barrel wall thereof. The swivel hook 3 is made of a steel wire rod, having one end terminating in a smoothly arched hook and an opposite end terminating in a stop flange 31.

Figure 4:
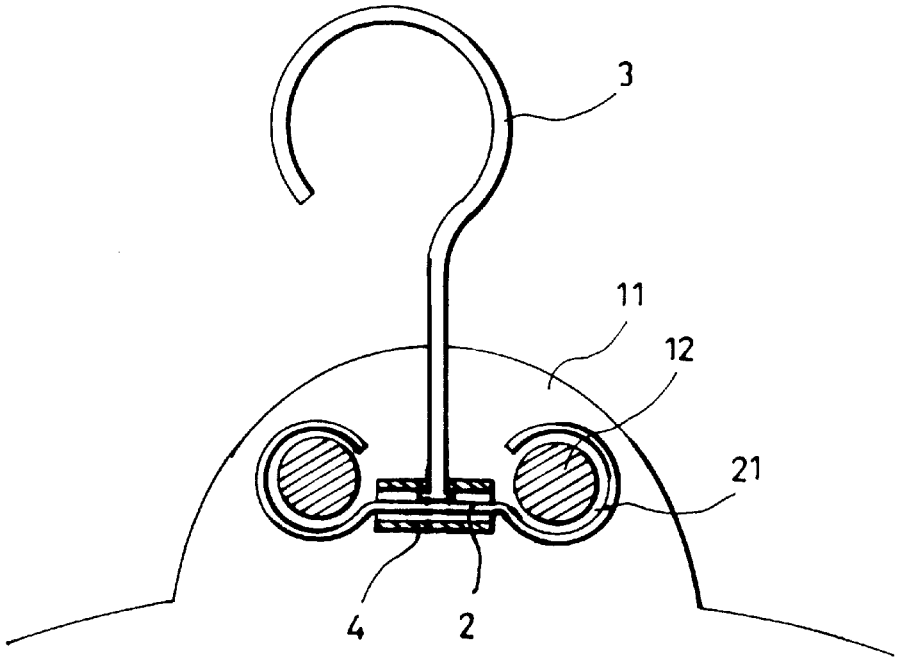
FIG. 4 is a sectional plain view in an enlarged scale of the upper part of the suit hanger shown in FIG. 1.

Referring to FIG. 4 and FIGS. from 1 through 3 again, before fixedly fastening up the overlapped end edges of the sheet material of the barrel 4, the swivel hook 3 is inserted through the through hole 41, and the reinforcing wire rod 2 is inserted into the barrel 4. After insertion of the swivel hook 3 into the through hole 41 at the barrel 4, the overlapped end edges of the sheet material of the barrel 4 are fixedly fastened up, keeping the barrel 4 in shape, and then the hook ends 21 of the reinforcing wire rod 2 are respectively hooked on the studs 12, and then the flexible sheet material of the hanger body 1 is folded up, and then the studs 12 are respectively forced into engagement with the sockets 13 to keep the hanger body 1 in shape. Because the shaped hanger body 1 has a three-dimensional profile, it keeps the loaded suit in shape. During delivery or when keeping in storage, the hanger body 1 is packed in the extended flat manner to minimize its storage space. Because the assembly process of the suit hanger is simple, the suit hanger can be sold in a detached package, and the consumer can assemble the suit hanger by oneself.

While only one embodiment of the present invention has been shown and described, it will be understood that various modifications and changes could be made thereunto without departing from the spirit and scope of the invention disclosed.

What the invention claimed is:

1. A suit hanger comprising:

a hanger body, said hanger body comprising a flexible sheet material, a plurality of sockets provided at said flexible sheet material at one side, and a plurality of studs provided at said flexible sheet material at an opposite side and respectively fastened to said sockets to hold said flexible sheet material in a folded position;

at least one reinforcing wire rod respectively fastened to sad studs, said at least one reinforcing wire rod each having two hooked ends respectively hooked on said studs;

a barrel mounted around said at least one reinforcing wire rod within said hanger body, said barrel comprising a through hole; and a swivel hook coupled to said barrel and extended out of said hanger body for hanging, said swivel hook comprising a first end terminating in a stop flange stopped inside said barrel, and a second end inserted through the through hole at said barrel and terminating in a hook disposed outside said hanger body for hanging.

2. The suit hanger of claim 1 wherein said flexible sheet material of said hanger body comprises a first lug at one side at which said sockets are provided, and a second lug at an opposite side at which said studs are provided.

3. The suit hanger of claim 2 wherein said flexible sheet material of said hanger body is molded from plastics.

4. The suit hanger of claim 1 wherein said sockets and said studs are formed integral with said flexible sheet material of said hanger body.

* * * * *